US005152917A

United States Patent [19]

Pieper et al.

[11] Patent Number: 5,152,917

[45] Date of Patent: Oct. 6, 1992

[54] STRUCTURED ABRASIVE ARTICLE

[75] Inventors: Jon R. Pieper, Lindstrom; Richard M. Olson, Stillwater, both of Minn.; Michael V. Mucci, Hudson, Wis.; Gary L. Holmes, Vadnais Heights; Robert V. Heiti, St. Paul, both of Minn.

[73] Assignee: Minnesota Mining and Manufacturing Company, St. Paul, Minn.

[21] Appl. No.: 651,660

[22] Filed: Feb. 6, 1991

[51] Int. Cl.[5] ..... B24D 3/00; B24D 11/04

[52] U.S. Cl. ..... 51/295; 51/298; 51/307; 51/309

[58] Field of Search ..... 51/293, 295, 298, 309, 51/308, 307

[56] References Cited

U.S. PATENT DOCUMENTS

| | | | |
|---|---|---|---|
| 1,657,784 | 1/1928 | Bergstrom | 51/295 |
| 2,001,911 | 5/1935 | Wooddell et al. | 51/190 |
| 2,108,645 | 2/1938 | Bryant | 91/68 |
| 2,252,683 | 8/1941 | Albertson | 51/293 |
| 2,292,261 | 8/1942 | Albertson | 51/195 |
| 2,682,733 | 7/1954 | Buckner | 51/288 |
| 2,755,607 | 7/1956 | Haywood | 51/185 |
| 2,820,746 | 1/1958 | Keeleric | 204/16 |
| 2,907,146 | 10/1959 | Dyar | 57/195 |
| 3,048,482 | 8/1962 | Hurst | 51/298 |
| 3,246,430 | 4/1966 | Hurst | 51/402 |
| 3,684,348 | 8/1972 | Rowland | 350/103 |
| 3,689,346 | 9/1972 | Rowland | 156/245 |
| 4,037,367 | 7/1977 | Kruse | 51/209 |
| 4,318,766 | 3/1982 | Smith | 156/330 |
| 4,420,527 | 12/1983 | Conley | 428/172 |
| 4,539,017 | 9/1985 | Augustin | 51/293 |
| 4,576,850 | 3/1986 | Martens | 428/156 |
| 4,652,274 | 3/1987 | Boettcher et al. | 51/298 |
| 4,735,632 | 4/1988 | Oxman et al. | 51/295 |
| 4,751,138 | 6/1988 | Tumey et al. | 428/323 |
| 4,773,920 | 9/1988 | Chasman et al. | 51/298 |
| 4,903,440 | 2/1990 | Larson et al. | 51/298 |
| 4,930,266 | 6/1990 | Calhoun et al. | 51/293 |
| 5,011,513 | 4/1991 | Zador et al. | 51/295 |
| 5,014,468 | 5/1991 | Ravipati et al. | 51/295 |

FOREIGN PATENT DOCUMENTS

| | | |
|---|---|---|
| 0396150 | 11/1990 | European Pat. Off. . |
| 881239 | 4/1943 | France . |
| 1005448 | 9/1965 | United Kingdom . |

OTHER PUBLICATIONS

Soviet Engineering Research, vol. 9, No. 6, (1989) New York, pp. 103–106 Search Report.

*Primary Examiner*—Mark L. Bell
*Assistant Examiner*—Deborah Jones
*Attorney, Agent, or Firm*—Gary L. Griswold; Walter N. Kirn; David L. Weinstein

[57] ABSTRACT

A coated abrasive article comprising a backing bearing on at least one major surface thereof abrasive composites comprising a plurality of abrasive grains dispersed in a binder. The binder serves as a medium for dispersing abrasive grains, and it may also bond the abrasive composites to the backing. The abrasive composites have a predetermined shape, e.g., pyramidal. The dimensions of a given shape can be made substantially uniform. Furthermore, the composites are disposed in a predetermined array. The predetermined array can exhibit some degree of repetitiveness. The repeating pattern of a predetermined array can be in linear form or in the form of a matrix. The coated abrasive article can be prepared by a method comprising the steps of: (1) introducing a slurry containing a mixture of a binder and a plurality of abrasive grains onto a production tool; (2) introducing a backing to the outer surface of the production tool such that the slurry wets one major surface of the backing to form an intermediate article; (3) at least partially curing or gelling the binder before the intermediate article departs from the outer surface of the production tool to form a coated abrasive article; and (4) removing said coated abrasive article from the production tool.

33 Claims, 7 Drawing Sheets

STRUCTURED ABRASIVE ARTICLE

BACKGROUND OF THE INVENTION

1. Field of the Invention

This invention relates to an abrasive article comprising a backing having a composite abrasive bonded thereto.

2. Discussion of the Art

Two major concerns associated with abrasive articles, particularly in fine grade articles, are loading and product consistency. Loading is a problem caused by the filling of the spaces between abrasive grains with swarf (i.e., material removed from the workpiece being abraded) and the subsequent build-up of that material. For example, in wood sanding, particles of sawdust lodge between abrasive grains, thereby reducing the cutting ability of the abrasive grains, and possibly resulting in burning of the surface of the wood workpiece.

U.S. Pat. No. 2,252,683 (Albertson) discloses an abrasive comprising a backing and a plurality of abrasive grains bonded to the backing by a resinous adhesive. During the manufacturing, before the resinous adhesive is cured, the abrasive article is placed in a heated mold which has a pattern. The inverse of the pattern transfers to the backing.

U.S. Pat. No. 2,292,261 (Albertson) discloses an abrasive article comprising a fibrous backing having an abrasive coating thereon. The abrasive coating contains abrasive particles embedded in a binder. When the binder is uncured, the abrasive coating is subjected to a pressure die containing a plurality of ridges. This results in the abrasive coating being embossed into rectangular grooves in the vertical and horizontal directions.

U.S. Pat. No. 3,246,430 (Hurst) discloses an abrasive article having a fibrous backing saturated with a thermoplastic adhesive. After the backing is preformed into a continuous ridge pattern, the bond system and abrasive grains are applied. This results in an abrasive article having high and low ridges of abrasive grains.

U.S. Pat. No. 4,539,017 (Augustin) discloses an abrasive article having a backing, a supporting layer of an elastomeric material over the backing, and an abrasive coating bonded to the supporting layer. The abrasive coating consists of abrasive grains distributed throughout a binder. Additionally the abrasive coating can be in the form of a pattern.

U.S. Pat. No. 4,773,920 (Chasman et al.) discloses an abrasive lapping article having an abrasive composite formed of abrasive grains distributed throughout a free radical curable binder. The patent also discloses that the abrasive composite can be shaped into a pattern via a rotogravure roll.

Although some of the abrasive articles made according to the aforementioned patents are loading resistant and inexpensive to manufacture, they lack a high degree of consistency. If the abrasive article is made via a conventional process, the adhesive or binder system can flow before or during curing, thereby adversely affecting product consistency.

It would be desirable to provide a loading resistant, inexpensive abrasive article having a high degree of consistency.

SUMMARY OF THE INVENTION

The present invention provides a structured abrasive article and a method of preparing such an article.

In one aspect, this invention involves a coated abrasive article comprising a backing having attached to at least one major surface thereof, in an array having a non-random pattern, a plurality of precisely shaped abrasive composites, each of said composites comprising a plurality of abrasive grains dispersed in a binder, which binder provides the means of attachment of the composites to the backing and it also serves to bond the abrasive composites to the backing. The abrasive composites have a precise shape, e.g., pyramidal. Before use, it is preferred that the individual abrasive grains in a composite do not project beyond the boundary which defines the shape of such composite. The dimensions of a given shape are substantially precise. Furthermore, the composites are disposed on the backing in a non-random array. The non-random array can exhibit some degree of repetitiveness. The repeating pattern of an array can be in linear form or in the form of a matrix.

In another aspect, this invention involves a coated abrasive article comprising a backing bearing on at least one major surface thereof a plurality of abrasive composites wherein each composite comprises a plurality of abrasive grains dispersed in a radiation-curable binder. Each abrasive composite has a precise shape and a plurality of such composites are disposed in a non-random array.

The precise nature of the abrasive composites provides an abrasive article that has a high level of consistency. This consistency further results in excellent performance.

In still another aspect, the invention involves a method of making a coated abrasive article comprising the steps of:

(1) introducing a slurry containing a mixture of a binder precursor and a plurality of abrasive grains into cavities contained on an outer surface of a production tool to fill such cavities;

(2) introducing a backing to the outer surface of the production tool over the filled cavities such that the slurry wets one major surface of the backing to form an intermediate article;

(3) curing the precursor binder before the intermediate article departs from the outer surface of the production tool to form a coated abrasive article; and (4) removing said coated abrasive article from the surface of the production tool.

It is preferred that the four steps are carried out in a continuous manner, thereby providing an efficient method of making a coated abrasive article. In either procedural embodiment, after the slurry is introduced to the production tool, the slurry does not exhibit appreciable flow prior to curing or gelling.

In a further aspect, the invention involves a method of making a coated abrasive article comprising the steps of:

(1) introducing a slurry containing a mixture of a binder and plurality of abrasive grains on to a front side of a backing such that the slurry wets the front side of the backing to form an intermediate article;

(2) introducing the slurry bearing side of the intermediate article to an outer surface of a production tool having a plurality of cavities in its outer surface to cause filling of such cavities.

(3) curing the binder precursor before the intermediate article departs from the outer surface of the production tool to form a coated abrasive article; and (4) removing the coated abrasive article from the surface of the production tool.

It is preferred that the four steps are carried out in a continuous manner, thereby providing an efficient method of making a coated abrasive article. In either procedural embodiment, after the slurry is introduced to the production tool, the slurry does not exhibit appreciable flow prior to curing or gelling.

DETAILED DESCRIPTION

The present invention provides a structured abrasive article and a method of making such an article. As used herein, the phrase "structured abrasive article" means an abrasive article wherein a plurality of precisely shaped abrasive composites, each composite comprising abrasive grains distributed in a binder having a predetermined precise shape and are disposed on a backing in a predetermined non-random array.

Figure 1:
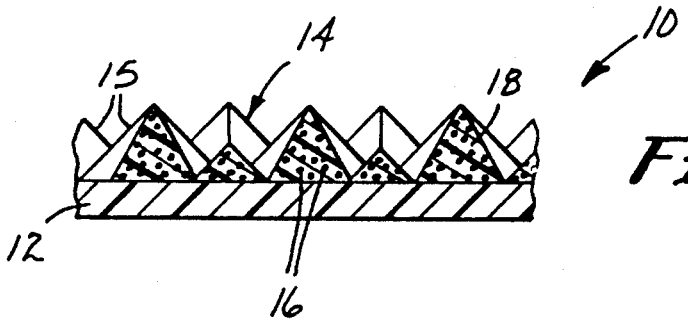
FIG. 1 is a side view in cross section of an abrasive article of the present invention.

Referring to FIG. 1, coated abrasive article 10 comprises a backing 12 bearing on one major surface thereof abrasive composites 14. The abrasive composites comprise a plurality of abrasive grains 16 dispersed in a binder 18. In this particular embodiment, the binder bonds abrasive composites 14 to backing 12. The abrasive composite has a discernible precise shape. It is preferred that the abrasive grains not protrude beyond the planes 15 of the shape before the coated abrasive article is used. As the coated abrasive article is being used to abrade a surface, the composite breaks down revealing unused abrasive grains.

Materials suitable for the backing of the present invention include polymeric film, paper, cloth, metallic film, vulcanized fiber, nonwoven substrates, combinations of the foregoing, and treated versions of the foregoing. It is preferred that the backing be a polymeric film, such as polyester film. In some cases, it is desired that the backing be transparent to ultraviolet radiation. It is also preferred that the film be primed with a material, such as polyethylene acrylic acid, to promote adhesion of the abrasive composites to the backing.

The backing can be laminated to another substrate after the coated abrasive article is formed. For example, the backing can be laminated to a stiffer, more rigid substrate, such as a metal plate, to produce a coated abrasive article having precisely shaped abrasive composites supported on a rigid substrate. The expression "precisely shaped abrasive composite", as used herein, refers to abrasive composites having a shape that has been formed by curing the curable binder of a flowable mixture of abrasive grains and curable binder while the mixture is both being borne on a backing and filling a cavity on the surface of a production tool. Such a precisely shaped abrasive composite would thus have precisely the same shape as that of the cavity. A plurality of such composites provide three-dimensional shapes that project outward from the surface of the backing in a non-random pattern, namely the inverse of the pattern of the production tool. Each composite is defined by a boundary, the base portion of the boundary being the interface with the backing to which the precisely shaped composite is adhered. The remaining portion of the boundary is defined by the cavity on the surface of the production tool in which the composite was cured. The entire outer surface of the composite is confined, either by the backing or by the cavity, during its formation.

The surface of the backing not containing abrasive composites may also contain a pressure-sensitive adhesive or a hook and loop type attachment system so that the abrasive article can be secured to a back-up pad. Examples of pressure-sensitive adhesives suitable for this purpose include rubber-based adhesives, acrylate-based adhesives, and silicone-based adhesives.

The abrasive composites can be formed from a slurry comprising a plurality of abrasive grains dispersed in an uncured or ungelled binder. Upon curing or gelling, the abrasive composites are set, i.e., fixed, in the predetermined shape and predetermined array.

The size of the abrasive grains can range from about 0.5 to about 1000 micrometers, preferably from about 1 to about 100 micrometers. A narrow distribution of particle size can often provide an abrasive article capable of producing a finer finish on the workpiece being abraded. Examples of abrasive grains suitable for this invention include fused aluminum oxide, heat treated aluminum oxide, ceramic aluminum oxide, silicon carbide, alumina zirconia, garnet, diamond, cubic boron nitride, and mixtures thereof.

The binder must be capable of providing a medium in which the abrasive grains can be distributed. The binder is preferably capable of being cured or gelled relatively quickly so that the abrasive article can be quickly fabricated. Some binders gel relatively quickly, but require a longer time to fully cure. Gelling preserves the shape of the composite until curing commences. Fast curing or fast gelling binders result in coated abrasive articles having abrasive composites of high consistency. Examples of binders suitable for this invention include phenolic resins, aminoplast resins, urethane resins, epoxy resins, acrylate resins, acrylated isocyanurate resins, urea-formaldehyde resins, isocyanurate resins, acrylated urethane resins, acrylated epoxy resins, glue, and mixtures thereof. The binder could also be a thermoplastic resin.

Depending upon the binder employed, the curing or gelling can be carried out by an energy source such as heat, infrared irradiation, electron beam, ultraviolet radiation, or visible radiation.

As stated previously, the binder can be radiation curable. A radiation-curable binder is any binder that can be at least partially cured or at least partially polymerized by radiation energy. Typically, these binders polymerize via a free radical mechanism. They are preferably selected from the group consisting of acrylated urethanes, acrylated epoxies, aminoplast derivatives having pendant $\alpha,\beta$-unsaturated carbonyl groups, ethylenically unsaturated compounds, isocyanurate derivatives having at least one pendant acrylate group, isocyanates having at least one pendant acrylate group, and mixtures thereof.

The acrylated urethanes are diacrylate esters of hydroxy terminated isocyanate (NCO) extended polyesters or polyethers. Representative examples of commercially available acrylated urethanes include UVITHANE 782, from Morton Thiokol, and CMD 6600, CMD 8400 and CMD 8805, from Radcure Specialties. The acrylated epoxies are diacrylate esters such as the diacrylate esters of bisphenol A epoxy resin. Examples of commercially available acrylated epoxies include CMD 3500, CMD 3600 and CMD 3700, from Radcure Specialties. The aminoplast derivatives have at least 1.1 pendant $\alpha,\beta$-unsaturated carbonyl groups and are further described in U.S. Pat. No. 4,903,440, incorporated herein by reference. Ethylenically unsaturated compounds include monomeric or polymeric compounds that contain atoms of carbon, hydrogen, and oxygen, and optionally, nitrogen and the halogens. Oxygen and nitrogen atoms are generally present in ether, ester, urethane, amide, and urea groups. Examples of such materials are further described in U.S. Pat. No. 4,903,440, previously incorporated herein by reference. Isocyanate derivatives having at least one pendant acrylate group and isocyanurate derivatives having at least one pendant acrylate group are described in U.S. Pat. No 4,652,274, incorporated herein by reference. The above-mentioned adhesives cure via a free radical polymerization mechanism.

Another binder suitable for the abrasive article of the present invention comprises the radiation-curable epoxy resin described in U.S. Pat. No. 4,318,766, incorporated herein by reference. This type of resin is preferably cured by ultraviolet radiation. This epoxy resin cures via a cationic polymerization mechanism initiated by an iodonium photoinitiator.

A mixture of an epoxy resin and an acrylate resin can also be used. Examples of such resin mixtures are described in U.S. Pat. No. 4,751,138, incorporated herein by reference.

If the binder is cured by ultraviolet radiation, a photoinitiator is required to initiate free radical polymerization. Examples of photoinitiators suitable for this purpose include organic peroxides, azo compounds, quinones, benzophenones, nitroso compounds, acryl halides, hydrazones, mercapto compounds, pyrylium compounds, triacrylimidazoles, bisimidazoles, chloralkyltriazines, benzoin ethers, benzil ketals, thioxanthones, and acetophenone derivatives. The preferred photoinitiator is 2,2-dimethoxy-1,2-diphenyl-1-ethanone.

If the binder is cured by visible radiation, a photoinitiator is required to initiate free radical polymerization. Examples of photoinitiators suitable for this purpose are described in U.S. Pat. No. 4,735,632, col. 3, line 25 through col. 4, line 10, col. 5, lines 1–7, col. 6, lines 1–35, incorporated herein by reference.

The ratio, based on weight, of abrasive grain to binder generally ranges from about 4 to 1 parts abrasive grains to 1 part binder, preferably from about 3 to 2 parts abrasive grains to 1 part binder. This ratio varies depending upon the size of the abrasive grains and the type of binder employed.

The coated abrasive article may contain an optional coating disposed between the backing and the abrasive composites. This coating serves to bond the abrasive composites to the backing. The coating can be prepared from the group of binder materials suitable for preparing the composites themselves.

The abrasive composite can contain other materials in addition to the abrasive grains and the binder. The materials, referred to as additives, include coupling agents, wetting agents, dyes, pigments, plasticizers, fillers, release agents, grinding aids, and mixtures thereof. It is preferred that the composite contains a coupling agent. The addition of the coupling agent significantly reduces the coating viscosity of the slurry used to form abrasive composites. Examples of such coupling agents suitable for this invention include organo silanes, zircoaluminates, and titanates. The weight of the coupling agent will generally be less than 5%, preferably less than 1%, of the binder, based on weight.

The abrasive composites have at least one predetermined shape and are disposed in a predetermined array. In general, the predetermined shape will repeat with a certain periodicity. This repeating shape can be in one direction or, preferably, in two directions. The surface profile is a measure of the reproducibility and consistency of the repeating shape. A surface profile can be determined by the following test.

Surface Profile Test

The abrasive article to be tested is placed on a flat surface and a probe (radius of five micrometers) from a profilometer (SURFCOM profilometer, commercially available from Tokyo Seimitsu Co., LTD., Japan) traverses the abrasive composite. The probe traverses at an angle perpendicular to the array of shapes and parallel to the plane of the backing of the abrasive article. Of course, the probe contacts the abrasive shapes. The traversal speed of the probe is 0.3 millimeter/second. The data analyzer is a SURFLYZER Surface Texture Analyzing System from Tokyo Seimitsu Co., LTD., Japan. The data analyzer graphs the profile of the shapes of the abrasive composites as the probe traverses and contacts the composites of the abrasive article. In the case of this invention, the graph will display a certain periodicity characteristic of a repeating shape. When the graph of one region of the article is compared to a graph of another region of the article, the amplitude and frequency of the output will essentially be the same, meaning that there is no random pattern, i.e., a very clear and definite repeating pattern is present.

The shapes of the abrasive composites repeat themselves at a certain periodicity. Typically, abrasive composites have a high peak (i.e., region) and a low peak (i.e., region). The high peak values from the data analyzer are within 10% of each other and the low peak values from the data analyzer are within 10% of each other.

Figure 3:
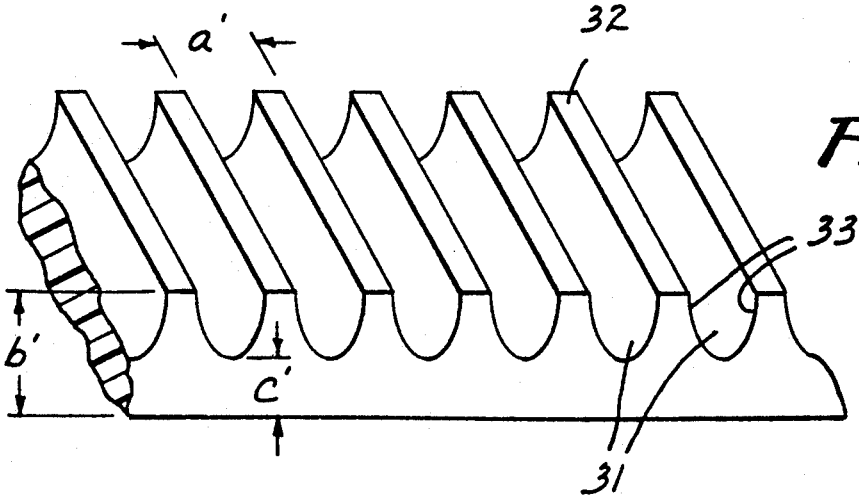
FIG. 3 is a perspective view of an abrasive article of the present invention.

An example of an ordered profile is illustrated in FIG. 3. The periodicity of the pattern is the distance marked "a'". The high peak value distance is marked "b'" and the low peak value distance is marked "c'".

The following procedure can be used as an alternative to the Surface Profile Test. A cross-sectional sample of the abrasive article is taken, e.g., as shown in FIG. 1. The sample is then embedded in a holder, so that the sample can be viewed under a microscope. Two microscopes that can be used for viewing the samples are a scanning electron microscope and an optical microscope. Next, the surface of the sample in the holder is polished by any conventional means so that the surface appears clean when the sample is viewed under the microscope. The sample is viewed under a microscope and a photomicrograph of the sample is taken. The photomicrograph is then digitized. During this step, x and y coordinates are assigned to map the predetermined shapes of the abrasive composites and the predetermined arrays.

A second sample of the abrasive article is prepared in the same manner as the first sample. The second sample should be taken along the same plane as the first sample to ensure that the shapes and arrays of the second sample are of the same type as those of the first sample. When the second sample is digitized, if the x and y coordinates of the two samples do not vary by more than 10%, it can be concluded that the shapes and array were predetermined. If the coordinates vary by more than 15%, it can be concluded that the shapes and array are random and not predetermined.

For abrasive composites that are characterized by distinct peaks or shapes, as in FIGS. 1, 6, 7, and 18, the digitized profile will vary throughout the array. In other words, peaks will differ from valleys in appearance. Thus, when the second sample is prepared, care must be taken so that the cross-section of the second sample corresponds exactly to the cross-section of the first sample, i.e., peaks correspond to peaks and valleys correspond to valleys. Each region of peaks or shapes will, however, have essentially the same geometry as another region of peaks or shapes. Thus, for a given digitized profile in one region of peaks or shapes, another digitized profile can be found in another region of peaks or shapes that is essentially the same as that of the first region.

The more consistent an abrasive article of this invention, the more consistent will be the finish imparted by the abrasive article to the workpiece. An abrasive article having an ordered profile has a high level of consistency, since the height of the peaks of the abrasive composites will normally not vary by more than 10%.

The coated abrasive article of this invention displays several advantages over coated abrasive articles of the prior art. In some cases, the abrasive articles have a longer life than abrasive articles not having abrasive composites positioned according to a predetermined array. The spaces between the composites provide means for escape of the swarf from the abrasive article, thereby reducing loading and the amount of heat built up during use. Additionally, the coated abrasive article of this invention can exhibit uniform wear and uniform grinding forces over its surface. As the abrasive article is used, abrasive grains are sloughed off and new abrasive grains are exposed, resulting in an abrasive product having a long life, high sustained cut rate, and consistent surface finish over the life of the product.

Figure 4:
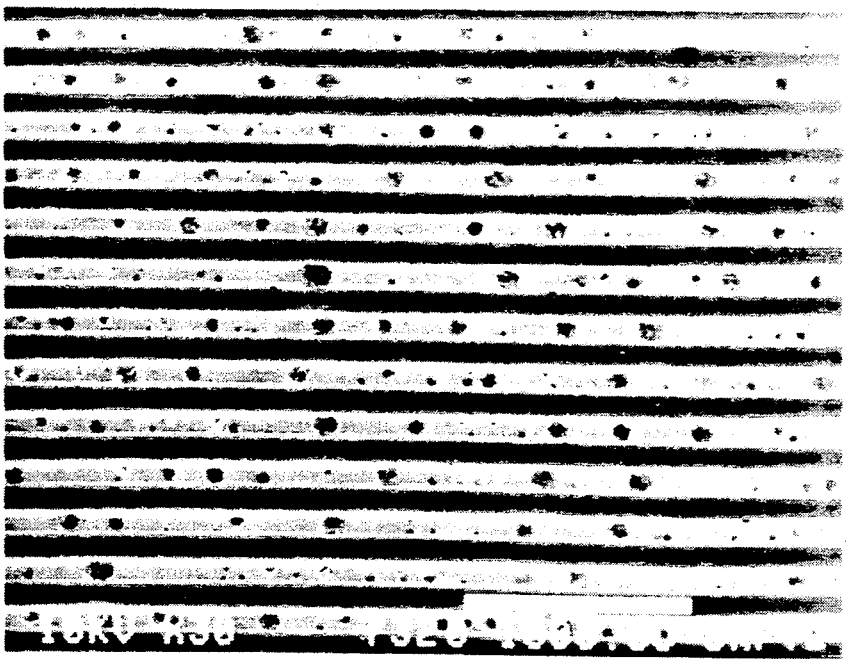
FIG. 4 is Scanning Electron Microscope photomicrograph taken at 30 times magnification of a top view of an abrasive article having an array of linear grooves.
Figure 5:
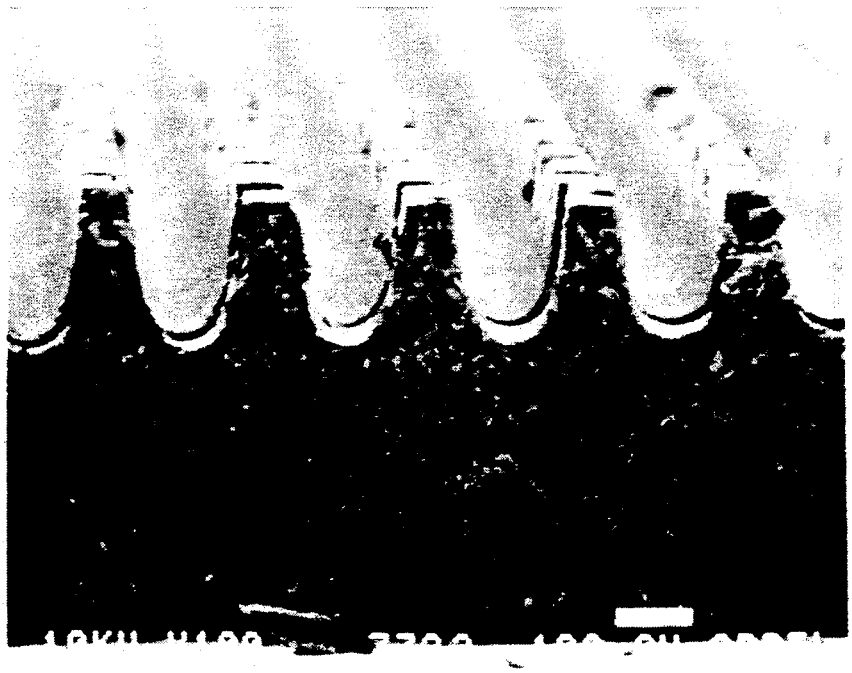
FIG. 5 is Scanning Electron Microscope photomicrograph taken at 100 times the magnification of a side view of an abrasive article having an array of linear grooves.
Figure 6:
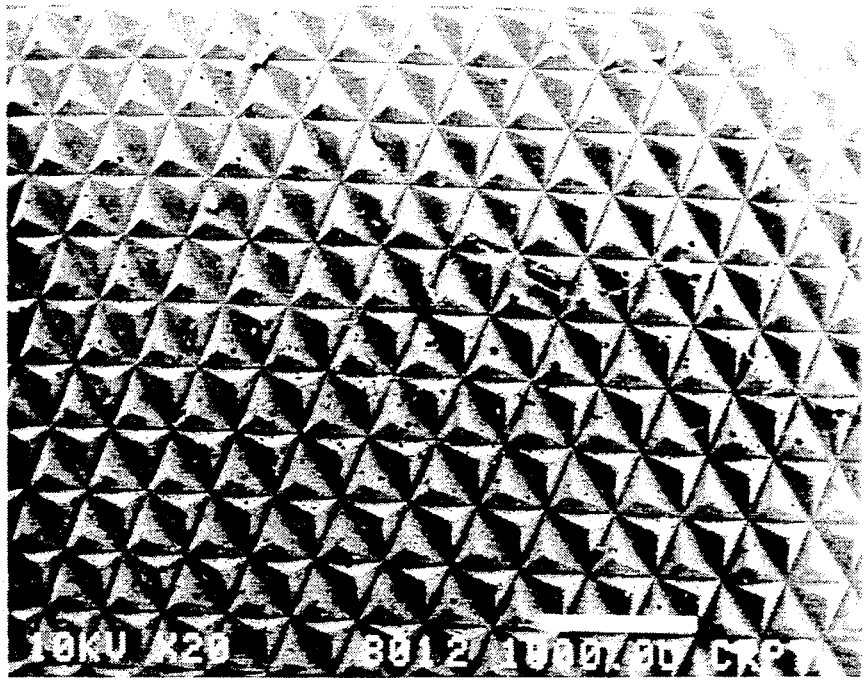
FIG. 6 is Scanning Electron Microscope photomicrograph taken at 20 times magnification of a top view of an abrasive article having an array of pyramidal shapes.
Figure 7:
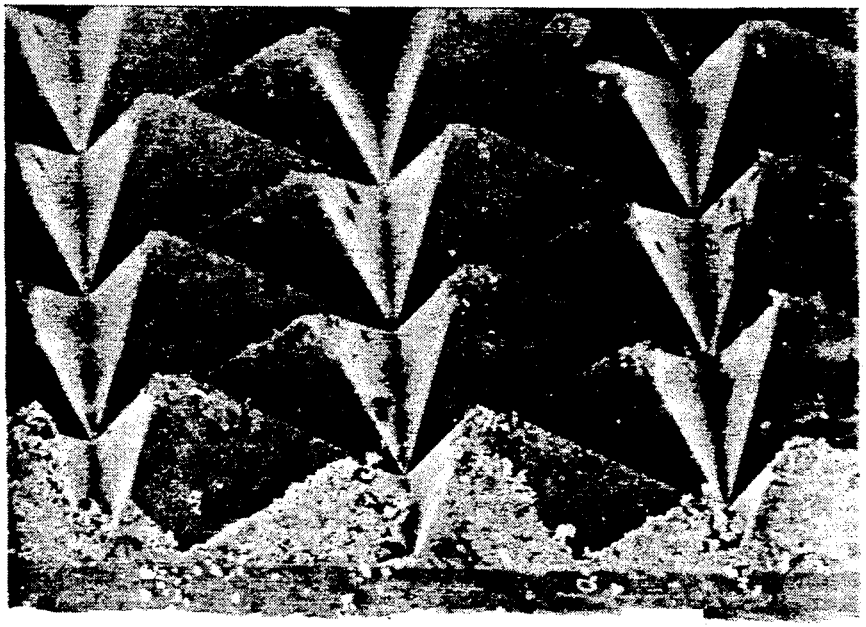
FIG. 7 is Scanning Electron Microscope photomicrograph taken at 100 times magnification of a side view of an abrasive article having an array of pyramidal shapes.
Figure 8:
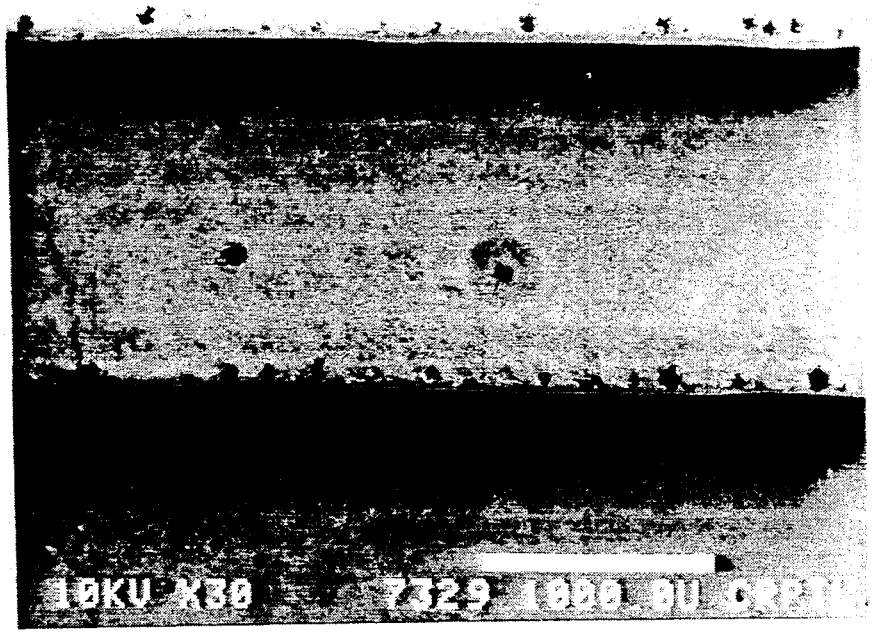
FIG. 8 is Scanning Electron Microscope photomicrograph (top view) taken at 30 times magnification of an abrasive article having an array of sawtooth shapes.
Figure 9:
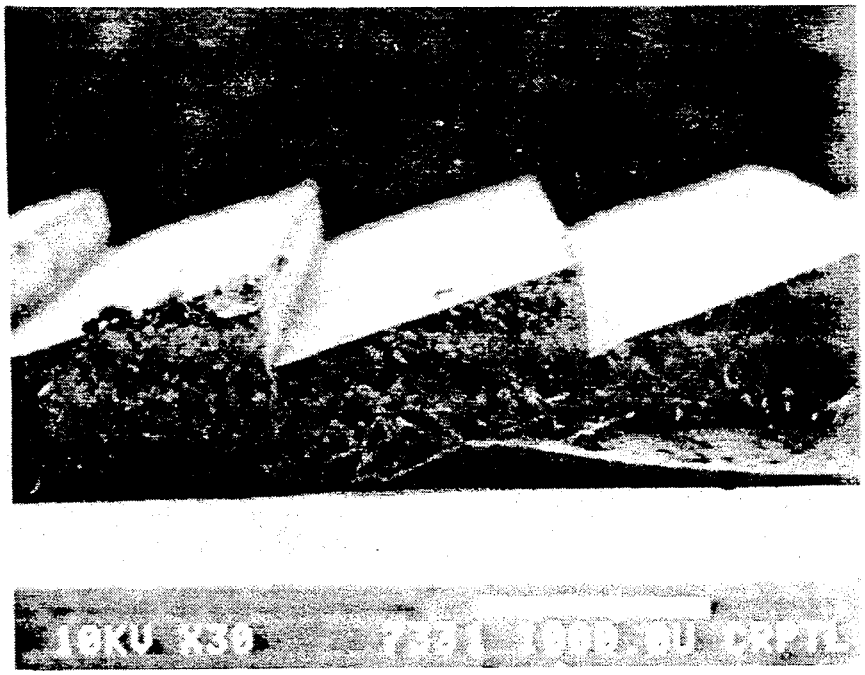
FIG. 9 is Scanning Electron Microscope photomicrograph (side view) taken at 30 times magnification of an abrasive article having an array of sawtooth shapes.

Abrasive composites disposed in a predetermined array can range through a wide variety of shapes and periods. FIGS. 4 and 5 show linear curved grooves. FIGS. 6 and 7 show pyramidal shapes. FIGS. 8 and 9 show linear grooves. FIG. 1 shows projections 14 of like size and shape and illustrates a structured surface made up of trihedral prism elements. FIG. 3 shows a series of steps 31 and lands 32.

Each composite has a boundary, which is defined by one or more planar surfaces. For example, in FIG. 1 the planar boundary is designated by reference numeral 15; in FIG. 3 the planar boundary is designated by reference numeral 33. The abrasive grains preferably do not project above the planar boundary. It is believed that such a construction allows an abrasive article to decrease the amount of loading resulting from grinding swarf. By controlling the planar boundary, the abrasive composites can be reproduced more consistently.

The optimum shape of a composite depends upon the particular abrading application. When the areal density of the composites, i.e., number of composites per unit area, is varied, different properties can be achieved. For example, a higher areal density tends to produce a lower unit pressure per composite during grinding, thereby allowing a finer surface finish. An array of continuous peaks can be disposed so as to result in a flexible product. For medium unit pressures, such as off hand grinding applications, it is preferred that the aspect ratio of the abrasive composites range from about 0.3 to about 1. An advantage of this invention is that the maximum distance between corresponding points on adjacent shapes can be less than one millimeter, and even less than 0.5 millimeter.

Coated abrasive articles of this invention can be prepared according to the following procedure. First, a slurry containing abrasive grains and binder is introduced to a production tool. Second, a backing having a front side and a back side is introduced to the outer surface of a production tool. The slurry wets the front side of the backing to form an intermediate article. Third, the binder is at least partially cured or gelled before the intermediate article is removed from the outer surface of the production tool. Fourth, the coated abrasive article is removed from the production tool. The four steps are preferably carried out in a continuous manner.

Figure 2:
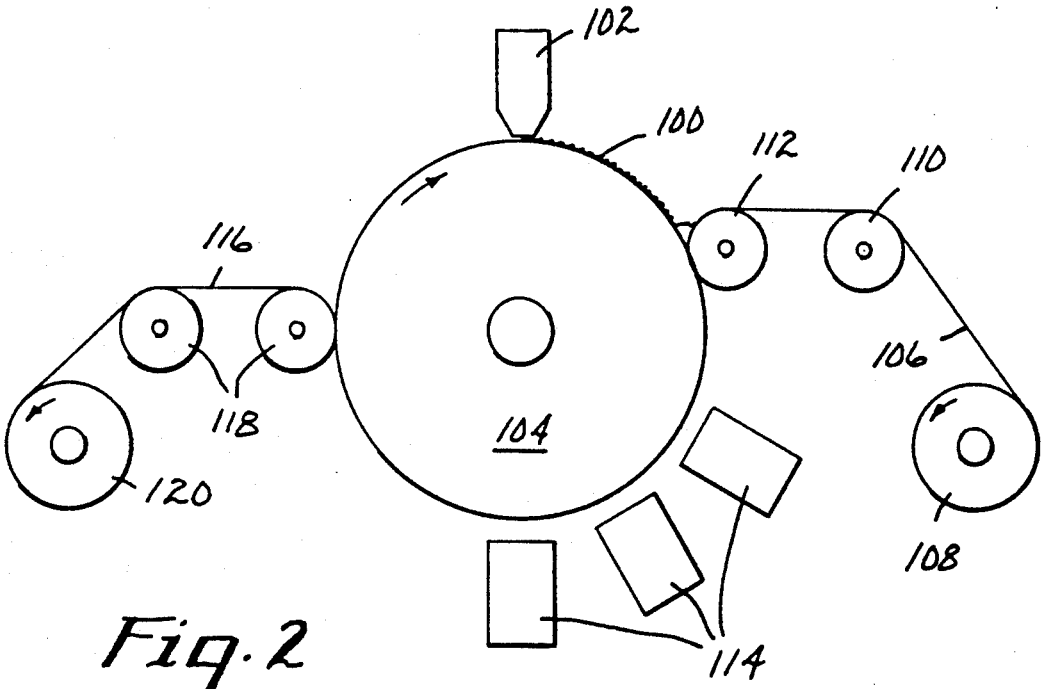
FIG. 2 is a schematic view of apparatus for making an abrasive article of the invention.

Referring to FIG. 2, which is a schematic diagram of the process of this invention, a slurry 100 flows out of a feeding trough 102 by pressure or gravity and onto a production tool 104, filling in cavities (not shown) therein. If slurry 100 does not fully fill the cavities, the resulting coated abrasive article will have voids or small imperfections on the surface of the abrasive composites and/or in the interior of the abrasive composites. Other ways of introducing the slurry to the production tool include die coating and vacuum drop die coating.

It is preferred that slurry 100 be heated prior to entering production tool 104, typically at a temperature in the range of 40° C. to 90° C. When slurry 100 is heated, it flows more readily into the cavities of production tool 104, thereby minimizing imperfections. The viscosity of the abrasive slurry is preferably closely controlled for several reasons. For example, if the viscosity is too high, it will be difficult to apply the abrasive slurry to the production tool.

Production tool 104 can be a belt, a sheet, a coating roll, a sleeve mounted on a coating roll, or a die. It is preferred that production tool 104 be a coating roll. Typically, a coating roll has a diameter between 25 and 45 cm and is constructed of a rigid material, such as metal. Production tool 104, once mounted onto a coating machine, can be powered by a power-driven motor.

Production tool 104 has a predetermined array of at least one specified shape on the surface thereof, which is the inverse of the predetermined array and specified shapes of the abrasive composite of the article of this invention. Production tools for the process can be prepared from metal, e.g., nickel, although plastic tools can also be used. A production tool made of metal can be fabricated by engraving, hobbing, assembling as a bundle a plurality of metal parts machined in the desired configuration, or other mechanical means, or by electroforming. The preferred method is diamond turning. These techniques are further described in the *Encyclopedia of Polymer Science and Technology*, Vol. 8, John Wiley & Sons, Inc. (1968), p. 651–665, and U.S. Pat. No. 3,689,346, column 7, lines 30 to 55, all incorporated herein by reference.

In some instances, a plastic production tool can be replicated from an original tool. The advantage of plastic tools as compared with metal tools is cost. A thermoplastic resin, such as polypropylene, can be embossed onto the metal tool at its melting temperature and then quenched to give a thermoplastic replica of the metal tool. This plastic replica can then be utilized as the production tool.

For radiation-curable binders, it is preferred that the production tool be heated, typically in the range of 30° to 140° C., to provide for easier processing and release of the abrasive article.

A backing 106 departs from an unwind station 108, then passes over an idler roll 110 and a nip roll 112 to gain the appropriate tension. Nip roll 112 also forces backing 106 against slurry 100, thereby causing the slurry to wet out backing 106 to form an intermediate article.

The binder is cured or gelled before the intermediate article departs from production tool 104. As used herein, "curing" means polymerizing into a solid state. "Gelling" means becoming very viscous, almost solid like. After curing or gelling, the specified shapes of the abrasive composites do not change after the coated abrasive article departs from production tool 104. In some cases, the binder can be gelled first, and then the intermediate article can be removed from production tool 104. The binder is then cured at a later time. Because the dimensional features do not change, the resulting coated abrasive article will have a very precise pattern. Thus, the coated abrasive article is an inverse replica of production tool 104.

The binder can be cured or gelled by an energy source 114 which provides energy such as heat, infrared radiation, or other radiation energy, such as electron beam radiation, ultraviolet radiation, or visible radiation. The energy source employed will depend upon the particular adhesive and backing used. Condensation curable resins can be cured or gelled by heat, radio frequency, microwave, or infrared radiation.

Addition polymerizable resins can be cured by heat, infrared, or preferably, electron beam radiation, ultraviolet radiation, or visible radiation. Electron beam radiation preferably has a dosage level of 0.1 to 10 Mrad, more preferably 1 to 6 Mrad. Ultraviolet radiation is non-particulate radiation having a wavelength within the range of 200 to 700 nanometers, more preferably between 250 to 400 nanometers. Visible radiation is nonparticulate radiation having a wavelength within the range of 400 to 800 nanometers, more preferably between 400 to 550 nanometers. Ultraviolet radiation is preferred. The rate of curing at a given level of radiation varies according to the thickness of the binder as well as the density, temperature, and nature of the composition.

The coated abrasive article 116 departs from production tool 104 and traverses over idler rolls 118 to a winder stand 120. The abrasive composites must adhere well to the backing, otherwise the composites will remain on production tool 104. It is preferred that production tool 104 contain or be coated with a release agent, such as a silicone material, to enhance the release of coated abrasive article 116.

In some instances, it is preferable to flex the abrasive article prior to use, depending upon the particular pattern employed and the abrading application for which the abrasive article is designed.

The abrasive article can also be made according to the following method. First, a slurry containing a mixture of a binder and plurality of abrasive grains is introduced to a backing having a front side and a back side. The slurry wets the front side of the backing to form an intermediate article. Second, the intermediate article is introduced to a production tool. Third, the binder is at least partially cured or gelled before the intermediate article departs from the outer surface of the production tool to form the abrasive article. Fourth, the abrasive article is removed from the production tool. The four steps are preferably conducted in a continuous manner, thereby providing an efficient method for preparing a coated abrasive article.

The second method is nearly identical to the first method, except that in the second method the abrasive slurry is initially applied to the backing rather than to the production tool. For example, the slurry can be applied to the backing between unwind station 108 and idler roll 110. The remaining steps and conditions for the second method are identical to those of the first method. Depending upon the particular configuration of the surface of the production tool, it may be preferable to use the second method instead of the first method.

In the second method, the slurry can be applied to the front side of the backing by such means as die coating, roll coating, or vacuum die coating. The weight of the slurry can be controlled by the backing tension and nip pressure and the flow rate of the slurry.

The following non-limiting examples will further illustrate the invention. All weights in the examples are given in $g/m^2$. All ratios in the following examples were based upon weight. The fused alumina used in the examples was a white fused alumina.

Figure 17:
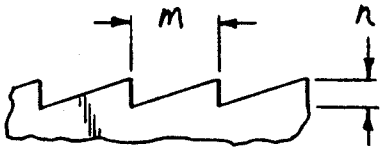
FIG. 17 is a front schematic view for an array of a specified pattern.
Figure 18:
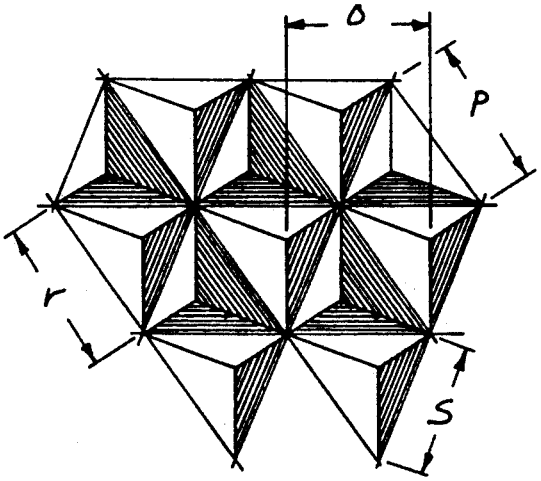
FIG. 18 is a front schematic view for an array of a specified pattern.
Figure 19:
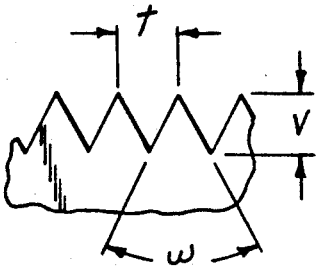
FIG. 19 is a front schematic view for an array of a specified pattern.

The following abbreviations are used throughout the examples:

| | |
|---|---|
| TMDIMA2 | dimethacryloxy ester of 2,2,4-trimethylhexamethylenediisocyanate |
| IBA | isobornylacrylate |
| BAM | an aminoplast resin having pendant acrylate functional groups, prepared in a manner similar to that described in U.S. Pat. No. 4,903,440, Preparation 2 |
| TATHEIC | triacrylate of tris(hydroxy ethyl)isocyanurate |
| AMP | an aminoplast resin having pendant acrylate functional groups, prepared in a manner similar to that described in U.S. Pat. No. 4,903,440, Preparation 4 |
| PH1 | 2,2-dimethoxy-1-2-diphenyl-1-ethanone, commercially available from Ciba Geigy Company under the trade designation IRGACURE 651 |
| LP1 | an array of curved shapes illustrated in FIG. 12 |
| LP2 | an array of curved shapes illustrated in FIG. 14 |
| LP3 | an array of linear shapes at a specified angle illustrated in FIG. 13 |
| LP4 | an array of shapes illustrated in FIG. 19 |
| LP5 | an array of linear shapes illustrated in FIG. 17 |
| LP6 | an array of linear grooves in which there are 40 lines/cm |
| CC | an array of pyramidal shapes illustrated in FIG. 18 |

Dry Push Pull Test

The abrasive article was converted to a 2.54 cm diameter disc. Double-coated transfer tape was laminated to the back side of the backing. The coated abrasive article was then pressed against a 2.54 cm diameter FINESSE-IT brand back up pad, commercially available from Minnesota Mining and Manufacturing Company, St. Paul, Minn. The workpiece was a 45 cm by 77 cm metal plate having a urethane primer. This type of primer is commonly used in the automotive paint industry. The coated abrasive article was used to abrade, by hand, approximately thirty (30) 2.54 cm by 22 cm sites on a sheet. The movement of the operator's hand in a back and forth manner constituted a stroke. The cut, i.e., the amount in micrometers of primer removed, was measured after 100 strokes. The paint thickness was measured with an ELCOMETER measurement tool, available from Elcometer Instruments Limited, Manchester, England. The finish, i.e., the surface finish of the metal primed plate, was measured after 10 to 100 strokes. The finish (Ra) was measured using a SURTRONIC 3 profilometer, available from Rauk Taylor Hobson Limited, from Leicester, England. Ra was the arithmetic average of the scratch size in microinches.

Wet Push Pull Test

The wet push pull test was identical to the dry push pull test, except that the primed metal plate surface was flooded with water.

EXAMPLES 1-5

The coated abrasive articles for Examples 1 through 5 illustrate various shapes and arrays of the abrasive article of this invention. These articles were made by means of a batch process. Example 1 illustrates a LP1 array; Example 2 illustrates a LP2 array; Example 3 illustrates a LP3 array; Example 4 illustrates a LP4 array; and Example 5 illustrates a CC array.

Figure 10:
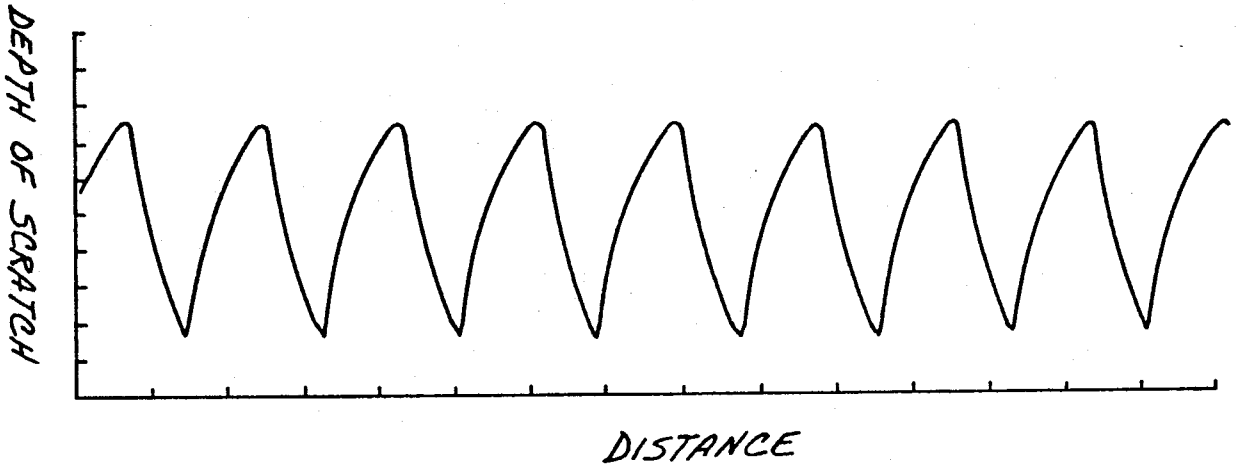
FIG. 10 is a graph from the Surface Profile Test of an abrasive article of the invention.

The production tool was a 16 cm by 16 cm square nickel plate containing the inverse of the array. The production tool was made by means of a conventional electroforming process. The backing was a polyester film (0.5 mm thick) that had been treated with $CF_4$ corona to prime the film. The binder consisted of 90% TMDIMA2/10% IBA/10% PHl adhesive. The abrasive grain was fused alumina (40 micrometer average particle size) and the weight ratio of abrasive grains to the binder in the slurry was 1 to 1. The slurry was applied to the production tool. Then the polyester film was placed over the slurry, and a rubber roll was applied over the polyester film so that the slurry wetted the surface of the film. Next, the production tool containing the slurry and the backing was exposed to ultraviolet light to cure the adhesive. The article of each sample was passed three times under an AETEK ultraviolet lamp operating at 400 Watts/inch at a speed of 40 feet/minute. Then the article of each example was removed from the production tool. The abrasive articles of Examples 1 through 5 were tested under the Dry Push Pull Test and the Wet Push Pull Test. The results of the Dry Push Pull Test are set forth in Table 1 and the results of the Wet Push Pull Test are set forth in Table 2. FIG. 10 illustrates the output of a Surface Profile Test for the coated abrasive article of Example 1.

TABLE 1

| Example no. | Cut (μm) | Surface finish (Ra) 10 cycles | Surface finish (Ra) 100 cycles |
|---|---|---|---|
| 1 | 5.6 | 16.6 | 11.3 |
| 2 | 3.1 | 13.5 | 14.5 |
| 3 | 7.6 | 13.7 | 10.0 |
| 4 | 3.4 | 15.0 | 9.0 |

TABLE 2

| Example no. | Cut (μm) | Surface finish (Ra) 10 cycles | Surface finish (Ra) 100 cycles |
|---|---|---|---|
| 1 | 18.5 | 17.5 | 12.0 |
| 2 | 11.7 | 20.0 | 8.0 |
| 3 | 39.9 | 15.0 | 12.0 |
| 4 | 30.0 | 17.5 | 9.5 |
| 5 | 53.3 | 24.0 | 18.5 |

EXAMPLE 6

The coated abrasive article of Example 6 was made in a manner identical to that used to prepare the articles of Examples 1 through 5, except that the array was LP5. The results of the Wet Push Pull Test are set forth in Table 3.

Comparative Example A was a grade 600 WETORDRY TRI-M-ITE paper coated abrasive, commercially available from Minnesota Mining and Manufacturing Company, St. Paul, Minn.

Comparative Example B was a grade 320 WETORDRY TRI-M-ITE paper coated abrasive, commercially available from Minnesota Mining and Manufacturing Company, St. Paul, Minn.

TABLE 3

| Example no. | Cut (μm) |
|---|---|
| 3 | 12.7 |
| 5 | 18.0 |
| 6 | 18.0 |

TABLE 3-continued

| Example no. | Cut (μm) |
|---|---|
| Comparative A | 7.7 |
| Comparative B | 30.9 |

From the foregoing data, it can be seen that those shapes with sharp features, i.e. those having either points or ridges, were the most effective and those shapes with flat features were less effective in removal of primer. In addition, the array LP3 displayed limited flexibility while the CC array was quiet flexible.

The article of Example 6 (the LP5 array) had a directionality in its pattern. The article of Example 6 was tested on a modified Dry Push Pull Test in which one stroke equaled one movement in one direction, reverse or forward. The results are set forth in Table 4.

TABLE 4

| Direction | Cut (μm) |
|---|---|
| reverse | 2.54 |
| forward | 7.62 |

EXAMPLES 7-11

The coated abrasive articles of Examples 7 through 11 were made in the same manner as were those of Examples 1 through 5, except that fused alumina grain having 12 micrometer average particle size was used. Example 7 illustrates a LP2 array; Example 8 illustrates a LP1 array; Example 9 illustrates a CC array; Example 10 illustrates a LP5 array; and Example 11 illustrates a LP3 array. The abrasive articles of these examples were tested under the Wet Push Pull Test and the results of the test are set forth in Table 5.

Comparative Example A was a grade 600 WETORDRY TRI-M-ITE a weight paper, commercially available from Minnesota Mining and Manufacturing Company, St. Paul, Minn.

TABLE 5

| | | Surface finish (Ra) | |
|---|---|---|---|
| Example no. | Cut (μm) | 10 cycles | 100 cycles |
| 7 | 23.0 | 11 | 5 |
| 8 | 30.5 | 12 | 5 |
| 9 | 30.5 | 12 | 5 |
| 10 | 30.5 | 13 | 6 |
| 11 | 38.1 | 8 | 6 |
| Comparative A | 23.0 | 11 | 5 |

EXAMPLES 12-14

The abrasive articles of Examples 12 through 14 were made in the same manner as were those of Examples 1 through 5, except that fused alumina grain having 90 micrometer average particle size was used. Example 12 illustrates a LP3 array; Example 13 illustrates a LP5 array; Example 14 illustrates a CC array. The abrasive articles of these examples were tested under the Dry Push Pull Test and the results are set forth in Table 6.

Comparative Example B was a grade 320 WETORDRY TRI-M-ITE A weight paper coated abrasive, commercially available from Minnesota Mining and Manufacturing Company, St. Paul, Minn.

TABLE 6

| | | Surface finish (Ra) | |
|---|---|---|---|
| Example no. | Cut (μm) | 10 cycles | 100 cycles |
| 12 | 36.3 | 40 | 34 |
| 13 | 48.3 | 60 | 45 |
| 14 | 50.8 | 55 | 49 |
| Comparative B | 30.5 | 62 | 33 |

Table 7 compares performance differences of an abrasive article containing an abrasive grain having 40 micrometer average particle size (Example 3) and an abrasive article containing an abrasive grain having 12 micrometer average particle size (Example 11) under the Dry Push Pull Test.

TABLE 7

| | | Surface finish (Ra) | |
|---|---|---|---|
| Example no. | Cut (μm) | 10 cycles | 90 cycles |
| 3 | 40.6 | 16.5 | 11.0 |
| 11 | 38.1 | 8.0 | 4.8 |

With the LP3 array, the cut was more dependent upon the array and shape of the composite than upon the particular size of the abrasive grain. It had been conventionally thought that the size of the abrasive grain employed had a significant influence on the cut. This phenomenon was surprising and was contrary to what is generally believed in the art.

EXAMPLES 15-16 AND COMPARATIVE EXAMPLES C AND D

These examples compared the performance of coated abrasive articles of the prior art with coated abrasive articles of the present invention. The coated abrasive articles of these examples were made by means of a continuous process and were tested under the Dry Push Pull Test, except that the cut was the amount of primer removed, in grams. Additionally, the surface finish was taken at the end of the test, and both Ra and RTM were measured in microinches. RTM was a weighted average measurement of the deepest scratches. The results are set forth in Table 8.

The coated abrasive articles for these examples were prepared with an apparatus that was substantially identical to that shown in FIG. 2. A slurry 100 containing abrasive grains was fed from a feeding trough 102 onto a production tool 104. Then a backing was introduced to production tool 104 in such a way that slurry 100 wetted the surface of the backing to form an intermediate article. The backing was forced into slurry 100 by means of a pressure roll 112. The binder in slurry 100 was cured to form a coated abrasive article. Then the coated abrasive article was removed from production tool 104. The slurry and the backing were made of the same materials as were used in Example 1. The temperature of the binder was 30° C. and the temperature of the production tool was 70° C.

EXAMPLES 15-16

For Examples 15 and 16, the ultraviolet lamps were positioned so as to cure the slurry on the production tool. For Example 15, the production tool was a gravure roll having a LP6 array. For Example 16, the production tool was a gravure roll having a CC array.

COMPARATIVE EXAMPLES C AND D

For Comparative Examples C and D, the ultraviolet lamps were positioned so as to cure the slurry after it had been removed from the production tool. Thus, there was a delay between the time when the intermediate article left the production tool and the time when the adhesive was cured or gelled. This delay allowed the adhesive to flow and alter the array and shape of the composite. For Comparative Example C, the production tool had a CC array; for Comparative Example D the production tool had a LP6 array.

Figure 11:
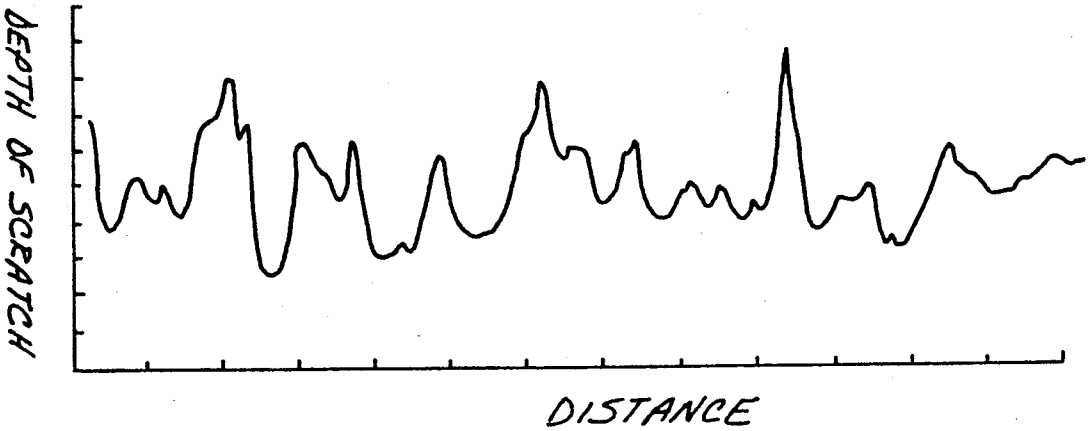
Fig. 11 PRIOR ART
FIG. 11 is a graph from the Surface Profile Test of an abrasive article made according to the prior art.
Figure 15:
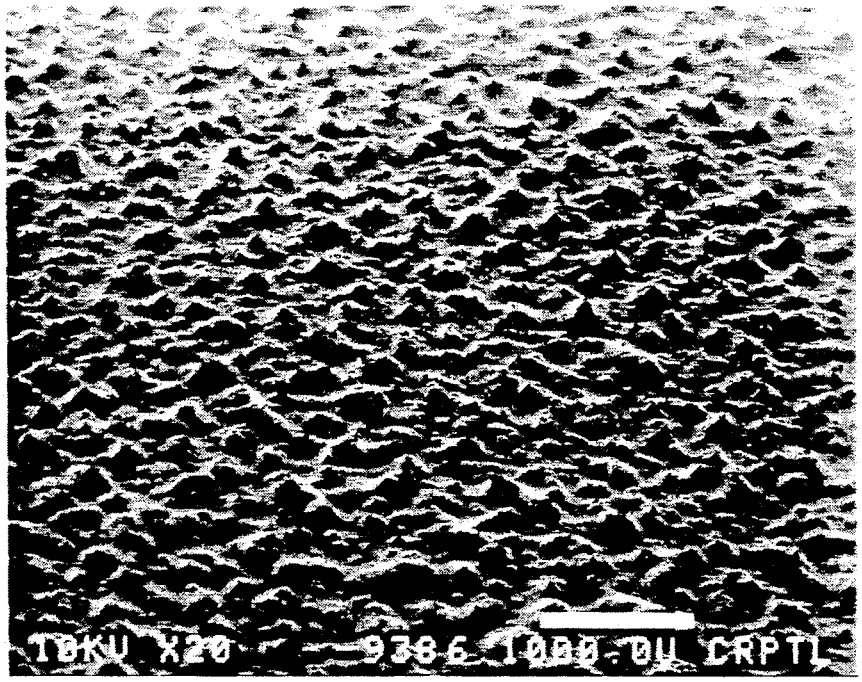
Fig. 15 PRIOR ART
FIG. 15 is a top view of a Scanning Electron Microscope photomicrograph taken at 20 times magnification of an abrasive article of the prior art.
Figure 16:
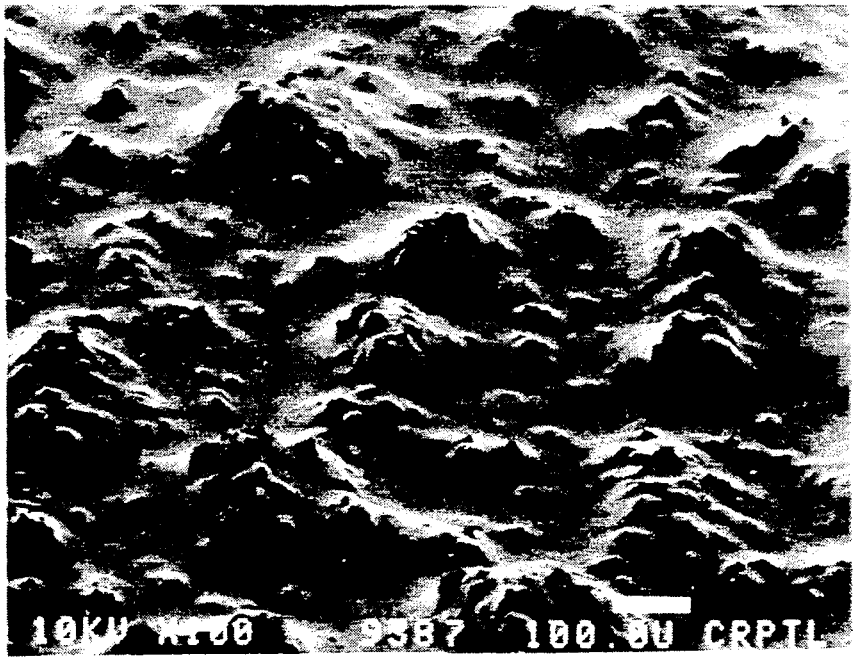
Fig. 16 PRIOR ART
FIG. 16 is a top view of a Scanning Electron Microscope photomicrograph taken at 100 times magnification of an abrasive article of the prior art.

The improvement in the coated abrasive articles of the present invention as compared to the coated abrasive articles of the prior art resulted from the curing or gelling on the production tool. This improvement is readily seen in the photomicrographs of FIGS. 6, 7, 15, and 16. FIGS. 15 and 16 pertain to Comparative Example C, while FIGS. 6 and 7 pertain to Example 16. FIG. 11 illustrates the output of a Surface Profile Test for the coated abrasive article of Comparative Example D.

TABLE 8

| Example no. | Cut (g) | Surface Finish Ra | Surface Finish RTM |
|---|---|---|---|
| 15 | 0.190 | 25 | 135 |
| 16 | 0.240 | 25 | 125 |
| 1 | 0.200 | 15 | 55 |
| Comparative C | 0.375 | 30 | 175 |
| Comparative D | 0.090 | 20 | 110 |

The most preferred coated abrasive product is one that has a high cut with low surface finish values. The abrasive articles of the present invention satisfy these criteria.

EXAMPLES 17-20

The abrasive articles of these examples illustrate the effect of various adhesives. The abrasive articles were made and tested in the same manner as was that of Example 1, except that a different adhesives were employed. The weight ratios for the materials in the slurry were the same as was that of Example 1. The adhesive for Example 17 was TMDIMA2, the adhesive for Example 18 was BAM, the adhesive for Example 19 was AMP, and the adhesive for Example 20 was TATHEIC. The test results are set forth in Table 9. Comparative Example A was a grade 600 WETORDRY TRI-M-ITE A weight paper, commercially available from Minnesota Mining and Manufacturing Company, St. Paul, Minn.

TABLE 9

| Example no. | Cut (μm) | Initial surface finish (Ra) 10 cycles |
|---|---|---|
| 17 | 9.14 | 12 |
| 18 | 2.54 | 10 |
| 19 | 7.61 | 8 |
| 20 | 16.00 | 5 |
| Comparative A | 1.52 | 10 |

EXAMPLES 21-24

The coated abrasive articles for Examples 21 through 24 were made in the same manner as was that of Example 16, except that different slurries were used. For Example 21, the abrasive slurry consisted of 40 micrometer average particle size fused alumina grain (100 parts)/TMDIMA2 (90 parts)/IBA (10 parts)/PHI (2 parts), for Example 22 the abrasive slurry consisted of 40 micrometer average particle size fused alumina grain (200 parts)/TMDIMA2 (90 parts)/IBA (10 parts)/PHI (2 parts), for Example 23 the abrasive slurry consisted of 40 micrometer average particle size fused alumina grain (200 parts)/AMP (90 parts)/IBA (10 parts)/PHI (2 parts), and for Example 24 the abrasive slurry consisted of 40 micrometer average particle size fused alumina grain (200 parts)/TATHEIC (90 parts)/IBA (10 parts)/PHI (2 parts). Comparative Example E was a grade 400 WETORDRY TRI-M-ITE A weight paper coated abrasive, commercially available from Minnesota Mining and Manufacturing Company, St. Paul, Minn.

Lap Test

The abrasive articles were converted into 35.6 cm diameter discs and tested on a RH STRASBAUGH 6AX lapping machine. The workpiece were three 1.2 cm diameter steel rods arranged in 7.5 cm diameter circle and set in a holder. The lapping was conducted in the absence of water, and the normal (perpendicular) load on the workpiece was one kilogram. The workpiece drive spindle was offset 7.6 cm. From the center of the lap to the workpiece drive spindles rotation was 63.5 rpm. The lap rotated at 65 rpm. The coated abrasive disc was attached to the abrasive holder by double-coated tape. The test was stopped at 5, 15, 30, and 60 minute intervals to measure cumulative cut. The test results are set forth in Table 10.

TABLE 10

| Example no. | Cut (g) 5 min. | Cut (g) 15 min. | Cut (g) 30 min. | Cut (g) 60 min. |
|---|---|---|---|---|
| 21 | 15.4 | 50.6 | 107.0 | 193.9 |
| 22 | 32.9 | 69.4 | 159.6 | 225.7 |
| 23 | 126.5 | 292.9 | 425.7 | 553.8 |
| 24 | 117.0 | 279.8 | 444.7 | 634.5 |
| Comparative E | 141.9 | 237.7 | 293.8 | 335.5 |

By the proper selection of the appropriate array and shape of composite, cut rate can be maximized, depth of the scratch can be minimized, and uniformity of the scratch pattern can be maximized.

The coated abrasive article of this invention did not load as much as did the coated abrasive article of Comparative Example E. The uniform array and shape of composites of the coated abrasive article of this invention contributed to its enhanced performance.

Figure 12:
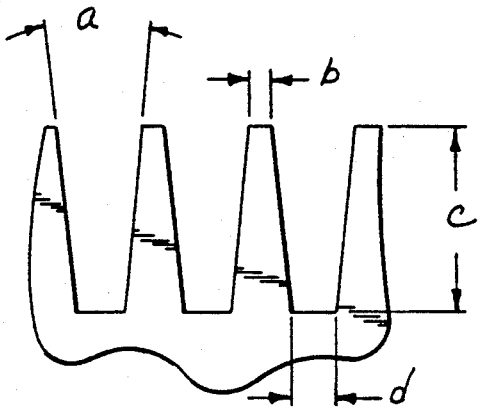
FIG. 12 is a front schematic view for an array of linear grooves.
Figure 14:
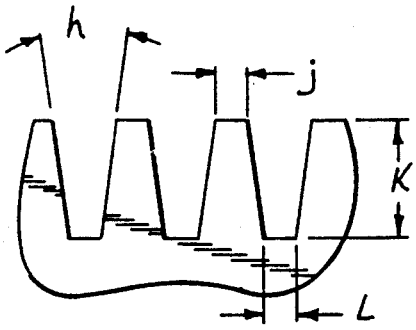
FIG. 14 is a front schematic view for an array of linear grooves.
Figure 13:
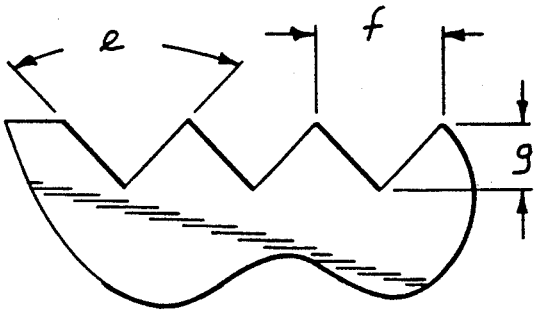
FIG. 13 is a front schematic view for an array of linear grooves.

In order to furnish guidance in the area of manufacturing production tools for preparing the coated abrasive articles of this invention, FIGS. 12-14, inclusive, and 17-19, inclusive, have been provided to set forth proposed dimensions for coated abrasive articles. The dimensions, i.e., inches or degrees of arc, are set forth in Table 11.

TABLE 11

| FIG. no. | Reference letter | Dimensions |
|---|---|---|
| 12 | a | 12° |
| | b | 0.0020 in. |
| | c | 0.0200 in. |
| | d | 0.0055 in. |
| 13 | e | 90° |
| | f | 0.0140 in. |
| | g | 0.0070 in. |
| 14 | h | 16° |
| | j | 0.0035 in. |
| | k | 0.0120 in. |
| | L | 0.0040 in. |
| 17 | m | 0.052 in. |
| | n | 0.014 in. |

TABLE 11-continued

| FIG. no. | Reference letter | Dimensions |
|---|---|---|
| 18 | o | 0.018 in. |
| | p | 0.018 in. |
| | r | 0.023 in. |
| | s | 0.017 in. |
| 19 | t | 0.004 in. |
| | v | 0.009 in. |
| | w | 53° |

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A coated abrasive article comprising a backing having attached to at least one major surface thereof, in an array having a non-random pattern, a plurality of precisely shaped abrasive composites, each of said composites comprising a plurality of abrasive grains dispersed in a binder, which binder provides the means of attachment of the composites to the backing.

2. The article of claim 1, wherein said binder is formed from a material curable by radiation energy.

3. The article of claim 1, wherein at least one of said precisely shaped abrasive composites is shaped as a pyramid.

4. The article of claim 1, wherein at least one of said precisely shaped abrasive composites is shaped as a prism.

5. The article of claim 1, wherein at least one of said precisely shaped abrasive composites has a curvilinear shape.

6. The article of claim 1, wherein said abrasive grains are formed of abrasive material selected from the group consisting of aluminum oxide, silicon carbide, alumina zirconia, garnet, diamond, cubic boron nitride, and mixtures thereof.

7. The article of claim 1, wherein said binder is selected from the group consisting of phenolic resins, aminoplast resins, urethane resins, epoxy resins, acrylate resins, acrylated isocyanurate resins, urea-formaldehyde resins, isocyanurate resins, acrylated urethane resins, acrylated epoxy resins, glue, and mixtures thereof.

8. The article of claim 1, wherein substantially the entire surface area of said at least one major surface of said backing is covered by said composites.

9. The article of claim 1, wherein at least a portion of the total surface area of said at least one major surface of said backing is free of said composites.

10. The article of claim 1, wherein said precisely shaped abrasive composites are positioned to define therebetween intersecting grooves.

11. The article of claim 1, wherein said backing comprises a backing which is coated over said at least one major surface with a layer of a second binder material.

12. The article of claim 11, wherein said second binder material is of the same composition as the binder which forms said composites.

13. The coated abrasive article of claim 1, wherein each composite has a boundary defined by one or more planar surfaces, said abrasive grains of said composite not projecting beyond the planar surface or surfaces of said boundary.

14. The coated abrasive article of claim 1, wherein each of said abrasive composites that forms said non-random pattern has a high peak and a low peak, the values of the height of said high peaks of said composites being within a range of 10% as measured by the probe of a profilometer and analyzed by a surface data analyzer and the values of the height of said low peaks of said composites being within a range of 10% as measured by the probe of a profilometer and analyzed by a surface data analyzer.

15. The coated abrasive article of claim 1, wherein the x-y coordinates of a digitized photomicrograph of a first region of said article vary by no more than 10% from the x-y coordinates of a digitized photomicrograph of a second region of said article, the cross-section of said second region corresponding exactly to the cross-section of said first region with respect to peaks and valleys of said first region and said second region.

16. A coated abrasive article comprising a backing having attached to at lest one major surface thereof, in an array having a non-random pattern, a plurality of precisely shaped abrasive composites, each of said composites comprising a plurality of abrasive grains dispersed in a binder, which binder is formed from a material curable by radiation energy.

17. The article of claim 16, wherein at least one of said precisely shaped abrasive composites is shaped as a pyramid.

18. The article of claim 16, wherein at least one of said precisely shaped abrasive composites is shaped as a prism.

19. The article of claim 16, wherein at least one of said precisely shaped abrasive composites has a curvilinear shape.

20. The article of claim 16, wherein said abrasive grains are formed of abrasive material selected from the group consisting of aluminum oxide, silicon carbide, alumina zirconia, garnet, diamond, cubic boron nitride, and mixtures thereof.

21. The article of claim 16, wherein said binder is selected from the group consisting of aminoplast resins, urethane resins, epoxy resins, acrylate resins, acrylated isocyanurate resins, urea-formaldehyde resins, isocyanurate resins, acrylated urethane resins, acrylated epoxy resins, and mixtures thereof.

22. The article of claim 16, wherein substantially the entire surface area of said at least one major surface of said backing is covered by said composites.

23. The article of claim 16, wherein at least a portion of the total surface area of said at least one major surface of said backing is free of said composites.

24. The article of claim 16, wherein said precisely shaped abrasive composites are positioned to define therebetween intersecting grooves.

25. The coated abrasive article of claim 16, wherein each composite has a boundary defined by one or more planar surfaces, said abrasive grains of said composite not projecting beyond the planar surface or surfaces of said boundary.

26. The coated abrasive article of claim 16, wherein each of said abrasive composites that forms said non-random pattern has a high peak and a low peak, the values of the height of said high peaks of said composites being within a range of 10% as measured by the probe of a profilometer and analyzed by a surface data analyzer and the values of the height of said low peaks of said composites being within a range of 10% as measured by the probe of a profilometer and analyzed by a surface data analyzer.

27. The coated abrasive article of claim 16, wherein the x-y coordinates of a digitized photomicrograph of a first region of said article vary by no more than 10% from the x-y coordinates of a digitized photomicrograph of a second region of said article, the cross-section of said second region corresponding exactly to the cross-section of said first region with respect to peaks and valleys of said first region and said second region.

28. The article of claim 6, wherein said aluminum oxide is fused aluminum oxide.

29. The article of claim 6, wherein said aluminum oxide is heat treated aluminum oxide.

30. The article of claim 6 wherein said aluminum oxide is ceramic aluminum oxide.

31. The article of claim 20, wherein said aluminum oxide is fused aluminum oxide.

32. The article of claim 20, wherein said aluminum oxide is heat treated aluminum oxide.

33. The article of claim 20, wherein said aluminum oxide is ceramic aluminum oxide.

* * * * *

UNITED STATES PATENT AND TRADEMARK OFFICE

CERTIFICATE OF CORRECTION

PATENT NO. : 5,152,917
DATED : October 6, 1992
INVENTOR(S) : Pieper, et. al.

It is certified that error appears in the above-indentified patent and that said Letters Patent is hereby corrected as shown below:

Column 2, line 58, after "binder", insert --Precursor--.

Column 18, line 20, "lest" should be --least--.

Signed and Sealed this

Twenty-eighth Day of June, 1994

Bruce Lehman

*Attest:*

BRUCE LEHMAN

*Attesting Officer*

*Commissioner of Patents and Trademarks*

US005152917B1

REEXAMINATION CERTIFICATE (3417th)

United States Patent [19] [11] B1 5,152,917

Pieper et al. [45] Certificate Issued Jan. 13, 1998

[54] STRUCTURED ABRASIVE ARTICLE

[75] Inventors: Jon R. Pieper, Lindstrom; Richard M. Olson, Stillwater, both of Minn.; Michael V. Mucci, Hudson, Wis.; Gary L. Holmes, Vadnais Heights; Robert V. Heiti, St. Paul, both of Minn.

[73] Assignee: Minnesota Mining and Manufacturing Company, St. Paul, Minn.

Reexamination Request:
No. 90/004,342, Aug. 26, 1996

Reexamination Certificate for:

| | |
|---|---|
| Patent No.: | **5,152,917** |
| Issued: | **Oct. 6, 1992** |
| Appl. No.: | **651,660** |
| Filed: | **Feb. 6, 1991** |

Certificate of Correction issued Jun. 28, 1994.

[51] Int. Cl.[6] ..... B24D 3/00; B24D 11/04

[52] U.S. Cl. ..... 51/295; 51/298; 51/307; 51/309

[58] Field of Search ..... 51/293, 295, 298, 51/307–308

[56] References Cited

U.S. PATENT DOCUMENTS

| | | | |
|---|---|---|---|
| 1,657,784 | 1/1928 | Bergstrom | 51/295 |
| 2,001,911 | 5/1935 | Wooddell et al. | 51/190 |
| 2,108,645 | 2/1938 | Bryant | 91/68 |
| 2,252,683 | 8/1941 | Albertson | 51/293 |
| 2,292,261 | 8/1942 | Albertson | 51/195 |
| 2,682,733 | 7/1954 | Buckner | 51/288 |
| 2,755,607 | 7/1956 | Haywood | 51/185 |
| 2,820,746 | 1/1958 | Keeleric | 204/16 |
| 2,907,146 | 10/1959 | Dyar | 57/195 |
| 3,048,482 | 8/1962 | Hurst | 51/298 |
| 3,246,430 | 4/1966 | Hurst | 51/402 |
| 3,684,348 | 8/1972 | Rowland | 350/103 |
| 3,689,346 | 9/1972 | Rowland | 156/245 |
| 4,037,367 | 7/1977 | Kruse | 51/209 |
| 4,314,827 | 2/1982 | Leitheiser et al. | 51/309 |
| 4,318,766 | 3/1982 | Smith | 156/330 |
| 4,420,527 | 12/1983 | Conley | 428/172 |
| 4,518,397 | 5/1985 | Leitheiser et al. | 51/293 |
| 4,539,017 | 9/1985 | Augustin | 51/293 |
| 4,574,003 | 3/1986 | Gerk | 51/309 |

(List continued on next page.)

FOREIGN PATENT DOCUMENTS

| | | |
|---|---|---|
| 881 239 | 4/1943 | France . |
| H2-83172 | 3/1990 | Japan . |
| 1 005 448 | 9/1965 | United Kingdom . |

OTHER PUBLICATIONS

Two letters relating to pre–filing confidential disclosures relating to fine grade coated abrasive products 1988.

Soviet Engineering Research, vol. 9, No. 6 (1989) New York, pp. 103–106 Search Report.

*Primary Examiner*—Deborah Jones

[57] ABSTRACT

A coated abrasive article comprising a backing bearing on at least one major surface thereof abrasive composites comprising a plurality of abrasive grains dispersed in a binder. The binder serves as a medium for dispersing abrasive grains, and it may also bond the abrasive composites to the backing. The abrasive composites have a predetermined shape, e.g., pyramidal. The dimensions of a given shape can be made substantially uniform. Furthermore, the composites are disposed in a predetermined array. The predetermined array can exhibit some degree of repetitiveness. The repeating pattern of a predetermined array can be in linear form or in the form of a matrix. The coated abrasive article can be prepared by a method comprising the steps of: (1) introducing a slurry containing a mixture of a binder and a plurality of abrasive grains onto a production tool; (2) introducing a backing to the outer surface of the production tool such that the slurry wets one major surface of the backing to form an intermediate article; (3) at least partially curing or gelling the binder before the intermediate article departs from the outer surface of the production tool to form a coated abrasive article; and (4) removing said coated abrasive article from the production tool.

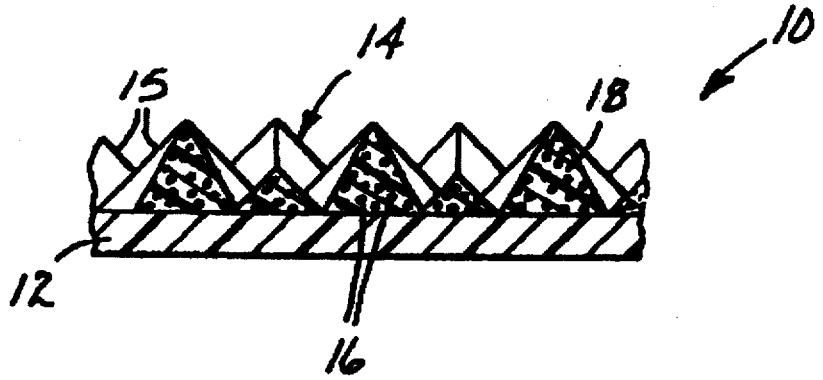

U.S. PATENT DOCUMENTS

| | | | |
|---|---|---|---|
| 4,576,850 | 3/1986 | Martens | 428/156 |
| 4,644,703 | 2/1987 | Kaczmarek et al. | 51/401 |
| 4,652,274 | 3/1987 | Boettcher et al. | 51/298 |
| 4,735,632 | 4/1988 | Oxman et al. | 51/298 |
| 4,744,802 | 5/1988 | Schwabel | 51/309 |
| 4,751,138 | 6/1988 | Tumey et al. | 428/323 |
| 4,773,920 | 9/1988 | Chasman et al. | 51/298 |
| 4,881,951 | 11/1989 | Wood et al. | 51/293 |
| 4,903,440 | 2/1990 | Larson et al. | 51/298 |
| 4,930,266 | 6/1990 | Calhoun et al. | 51/293 |
| 5,011,508 | 4/1991 | Wald et al. | 51/293 |
| 5,011,513 | 4/1991 | Zador et al. | 51/295 |
| 5,014,468 | 5/1991 | Ravipati et al. | 51/295 |
| 5,527,368 | 6/1996 | Supkis et al. | 51/298 |

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–33 is confirmed.

New claims 34–35 are added and determined to be patentable.

*34. The article of claim 16 wherein the plurality of precisely shaped abrasive composites are separated by linear grooves.*

*35. The article of claim 1 wherein the plurality of precisely shaped abrasive composites are separated by linear grooves.*

* * * * *